US007862376B2

(12) United States Patent
Sypolt et al.

(10) Patent No.: US 7,862,376 B2
(45) Date of Patent: Jan. 4, 2011

(54) COMPLIANT PIN FOR RETAINING AND ELECTRICALLY CONNECTING A SHIELD WITH A CONNECTOR ASSEMBLY

(75) Inventors: Matthew Sypolt, Harrisburg, PA (US); James Lee Fedder, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 198 days.

(21) Appl. No.: 12/236,131

(22) Filed: Sep. 23, 2008

(65) Prior Publication Data

US 2010/0075548 A1 Mar. 25, 2010

(51) Int. Cl.
*H01R 13/648* (2006.01)

(52) U.S. Cl. ..... 439/607.07

(58) Field of Classification Search ..... 439/751, 439/82, 607.05–607.07
See application file for complete search history.

(56) References Cited

U.S. PATENT DOCUMENTS 2,183,067 A * 12/1939 Gardner ..... 439/825
3,696,323 A * 10/1972 Kinkaid et al. ..... 439/525
3,997,237 A * 12/1976 White ..... 439/876
4,186,982 A * 2/1980 Cobaugh et al. ..... 439/82
4,655,537 A * 4/1987 Andrews, Jr. ..... 439/751
4,737,114 A * 4/1988 Yaegashi ..... 439/82
4,906,209 A * 3/1990 Tanabe et al. ..... 439/620.24
5,055,072 A * 10/1991 Shinoda ..... 439/751
6,524,129 B2 * 2/2003 Cote et al. ..... 439/511
6,743,057 B2 * 6/2004 Davis et al. ..... 439/701
6,932,649 B1 * 8/2005 Rothermel et al. ..... 439/620.01
7,074,094 B2 7/2006 Kawahara et al.
7,172,461 B2 * 2/2007 Davis et al. ..... 439/607.11
7,175,446 B2 * 2/2007 Bright et al. ..... 439/79
7,357,673 B2 4/2008 Long
7,410,393 B1 * 8/2008 Rothermel et al. ..... 439/607.05
7,585,186 B2 * 9/2009 McAlonis et al. ..... 439/607.05
7,618,289 B2 * 11/2009 Rothermel et al. ..... 439/607.07

* cited by examiner

*Primary Examiner*—Neil Abrams

(57) ABSTRACT

A compliant pin is configured to be press-fit into a cavity of at least one of a connector assembly and a substrate to retain the pin in the cavity. The pin includes a neck, a plurality of compliant beams, and an insertion tip. The neck interconnects the pin with the connector assembly. The beams are configured to engage an inner surface of the cavity to retain the pin in the cavity. The beams are arranged side-to-side and project along a longitudinal plane in a loading direction. The beams have arcuate portions that are arched in different directions transverse to the longitudinal plane. The arcuate portions are shaped to deflect toward the longitudinal plane without substantially engaging one another. The insertion tip interconnects the ends of the beams.

20 Claims, 8 Drawing Sheets

COMPLIANT PIN FOR RETAINING AND ELECTRICALLY CONNECTING A SHIELD WITH A CONNECTOR ASSEMBLY

BACKGROUND OF THE INVENTION

The subject matter herein generally relates to electrical connectors and, more particularly, to compliant pins for electrical connectors.

Known Eye-Of-Needle ("EON") pins are used to mechanically and electrically connect shields in connector assemblies with at least one of another component of the connector assembly and a substrate. For example, known EON pins are used to electrically connect shields with the electric ground of a circuit board and/or a conductor that is electrically connected to the electric ground of the circuit board. The EON pins are press-fit into cavities in the circuit board and/or another component in the connector assembly. The EON pins include an approximately oval shaped opening enclosed by outwardly bent beams of the EON pins. The EON pins are press-fit into cavities by applying an insertion force on the EON pins in a loading direction directed into the cavities. Application of the insertion force on the EON pins in the loading direction forces the EON pins into the cavities. As the EON pins are forced into the cavities, the beams are bent toward each other. The beams engage the inner surface of the cavity to electrically and mechanically couple the pin with the circuit board and/or component in the connector assembly.

These EON pins are relatively large when compared to the size and dimensions of other known signal pins used in the same connector assemblies. Moreover, these EON pins require relatively large insertion forces when compared to the structural integrity of the EON pins. For example, the insertion forces required to press-fit the EON pins into the cavities frequently cause the EON pins to buckle if the EON pins are not perfectly aligned with the cavities.

BRIEF DESCRIPTION OF THE INVENTION

In one embodiment, a compliant pin is configured to be press-fit into a cavity of at least one of a connector assembly and a substrate to retain the pin in the cavity. The pin includes a neck, a plurality of compliant beams, and an insertion tip. The neck interconnects the pin with the connector assembly. The beams are configured to engage an inner surface of the cavity to retain the pin in the cavity. The beams are arranged side-to-side and project along a longitudinal plane in a loading direction. The beams have arcuate portions that are arched in different directions transverse to the longitudinal plane. The arcuate portions are shaped to deflect toward the longitudinal plane without substantially engaging one another. The insertion tip interconnects the ends of the beams.

In another embodiment, a connector assembly includes a contact module assembly and a shield. The contact module assembly includes a lead frame that has a cavity and is configured to electrically connect the connector assembly with an electric ground. The shield has a compliant pin press-fit into the cavity to retain the shield with respect to the lead frame and to electrically connect the shield with the electric ground. The pin includes a neck, a plurality of compliant beams and an insertion tip. The neck interconnects the pin with the shield. The beams are configured to engage an inner surface of the cavity to retain the pin in the cavity. The beams are arranged side-to-side and project along a longitudinal plane in a loading direction. The beams have arcuate portions that are arched in different directions transverse to the longitudinal plane. The arcuate portions arc shaped to deflect toward the longitudinal plane without substantially engaging one another. The insertion tip interconnects the ends of the beams.

DETAILED DESCRIPTION OF THE INVENTION

Figure 1:
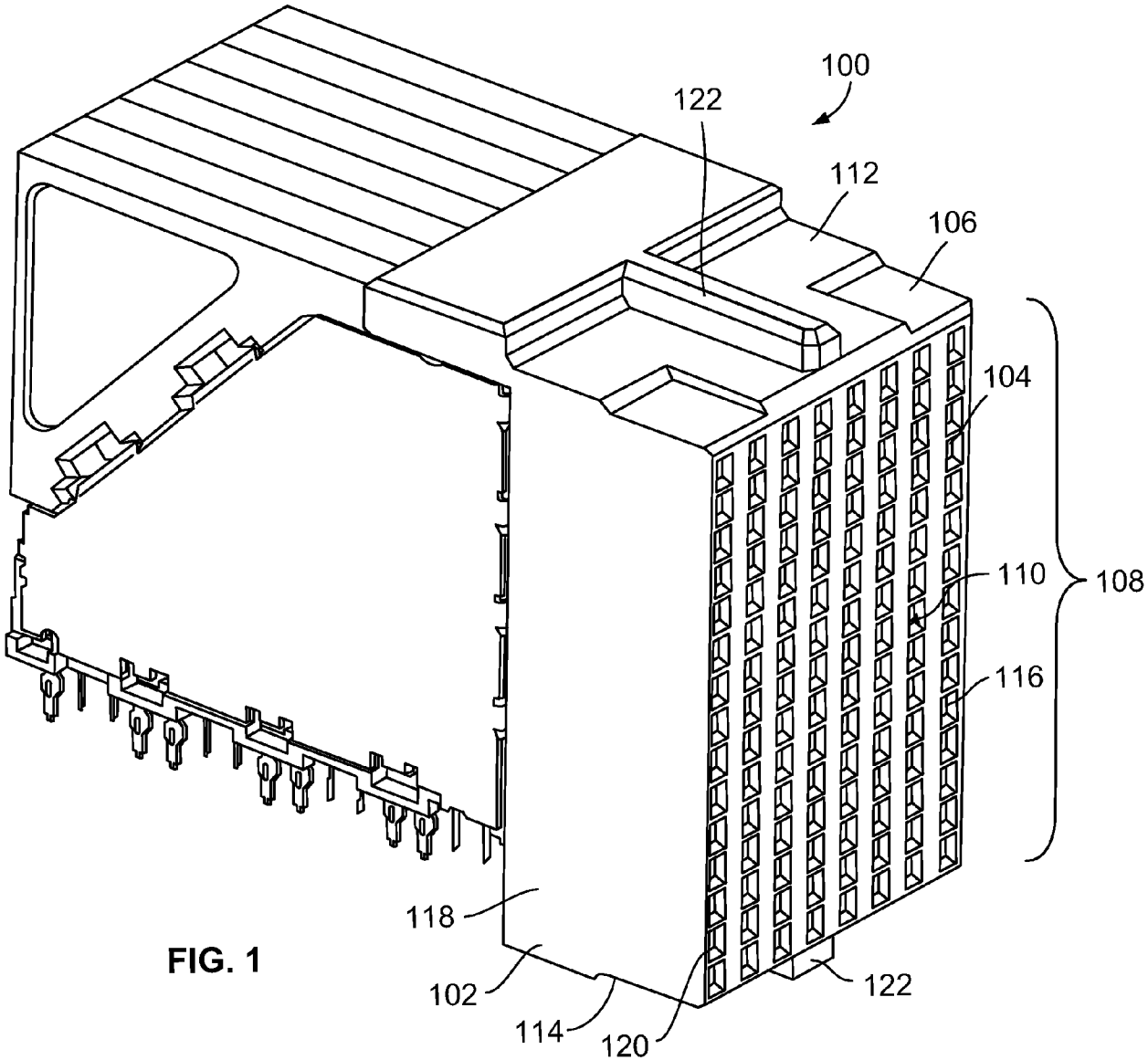
FIG. 1 is a perspective view of an electrical connector assembly according to one embodiment.

FIG. 1 is a perspective view of an electrical connector assembly 100 according to one embodiment. While the connector assembly 100 is described herein with particular reference to a backplane receptacle connector, it is to be understood that the benefits herein described are also applicable to other connectors in alternative embodiments. The following description is therefore provided for purposes of illustration, rather than limitation, and is but one potential application of the subject matter herein. The connector assembly 100 includes a dielectric housing 102 having a forward mating end 104 that includes a shroud 106 having a mating interface 108 at the mating end 104. A plurality of mating contacts 200 (shown in FIG. 2), such as, for example, contacts within contact cavities 110, are provided proximate to the mating interface 108 and are configured to receive corresponding mating contacts (not shown) from a mating connector (not shown). The shroud 106 includes an upper surface 112 and a lower surface 114 between opposed sides 116, 118. The upper and lower surfaces 112, 114 and sides 116, 118 each include a chamfered forward edge portion 120. An alignment rib 122 is formed on the upper surface 112 and lower surface 114. The forward edge portion 120 and the alignment ribs 122 cooperate to bring the connector assembly 100 into alignment with the mating connector during the mating process so that the contacts in the mating connector are received in the contact cavities 110 without damage.

Figure 2:
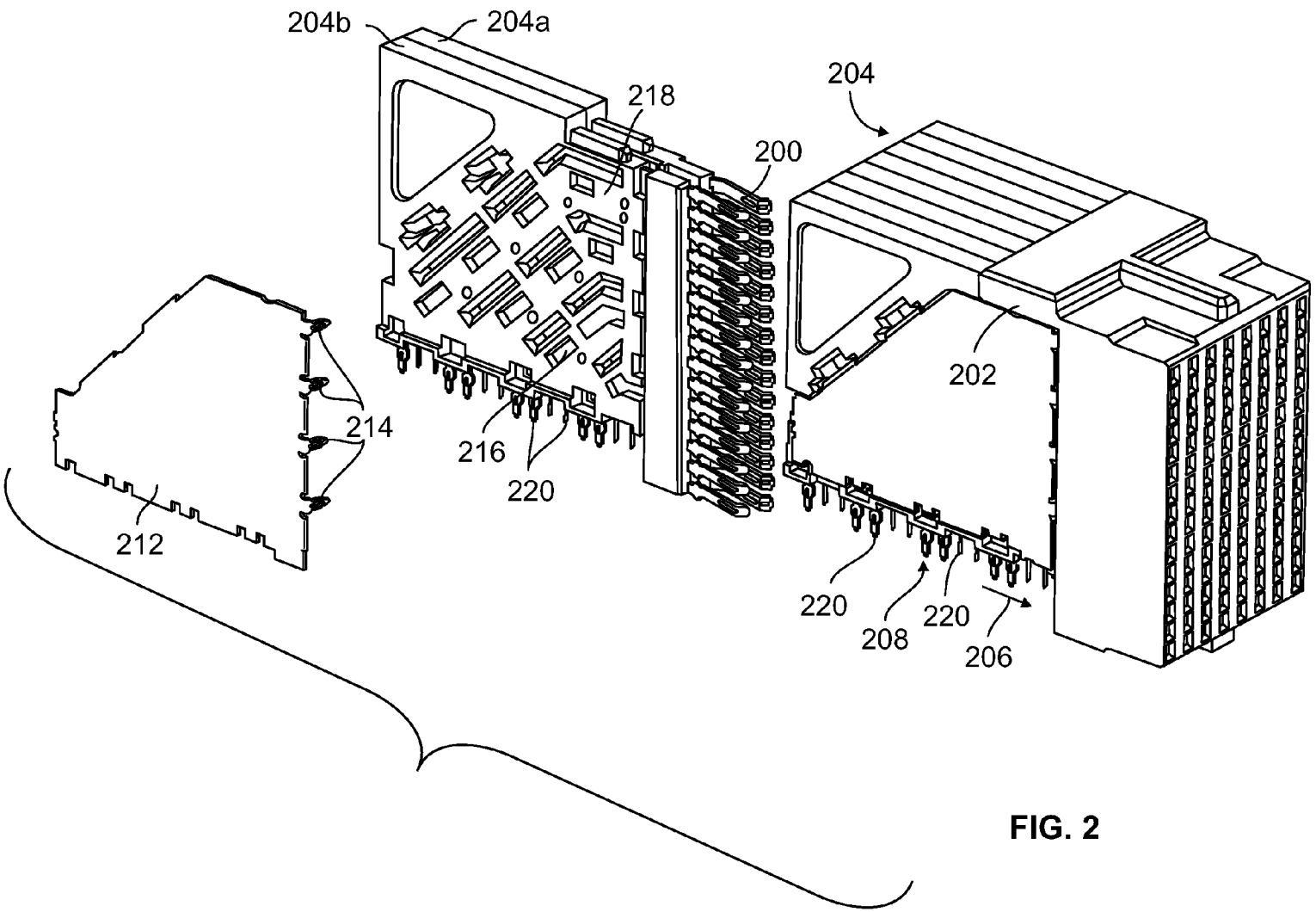
FIG. 2 is an exploded view of the connector assembly shown in FIG. 1.

FIG. 2 is an exploded view of the connector assembly 100. As shown in FIG. 2, the housing 102 also includes a rearwardly extending hood 202. A plurality of contact module assemblies 204 are received in the housing 102 from a rearward end 206. The contact module assemblies 204 define a connector mounting interface 208. The connector mounting interface 208 includes a plurality of mounting contacts 220, such as, but not limited to, pin contacts, that are configured to be mounted to a substrate (not shown), such as, but not limited to, a circuit board. The mounting contacts 220 include ground and signal contacts. In one embodiment, the mounting interface 208 is substantially perpendicular to the mating interface 108 such that the electrical connector assembly 100 interconnects electrical components that are substantially at a right angle to one another. The housing 102 may hold two or more different types of contact module assemblies 204, such as, but not limited to, contact module assemblies 204A, 204B. Alternatively, the housing 102 may hold only a single type of contact module assembly 204, such as, but not limited to, any of the contact module assemblies 204A, 204B.

In an example embodiment, each of the contact module assemblies 204 includes a lead frame 216 that is partially housed in a dielectric body 218. As illustrated in FIG. 2, the lead frame 216 is enclosed within the body 218, but is at least partially exposed by the body 218 in certain areas. In one or more embodiments, the body 218 is manufactured using an over-molding process. During the molding process, the lead frame 216 is encased in a dielectric material, which forms the body 218. The mating contacts 200 and mounting contacts 220 extend from the body 218 and the lead frame 216. The contact module assemblies 204 include a shield 212 that extends along one side thereof. Optionally, the shield 212 may define a ground plane for the respective contact module assembly 204. In the illustrated embodiment, the shield 212 includes a plurality of compliant pins 214 that electrically and mechanically connects to the lead frame 216. Optionally, the shield 212 may be used to provide shielding between adjacent contact module assemblies 204.

Figure 3:
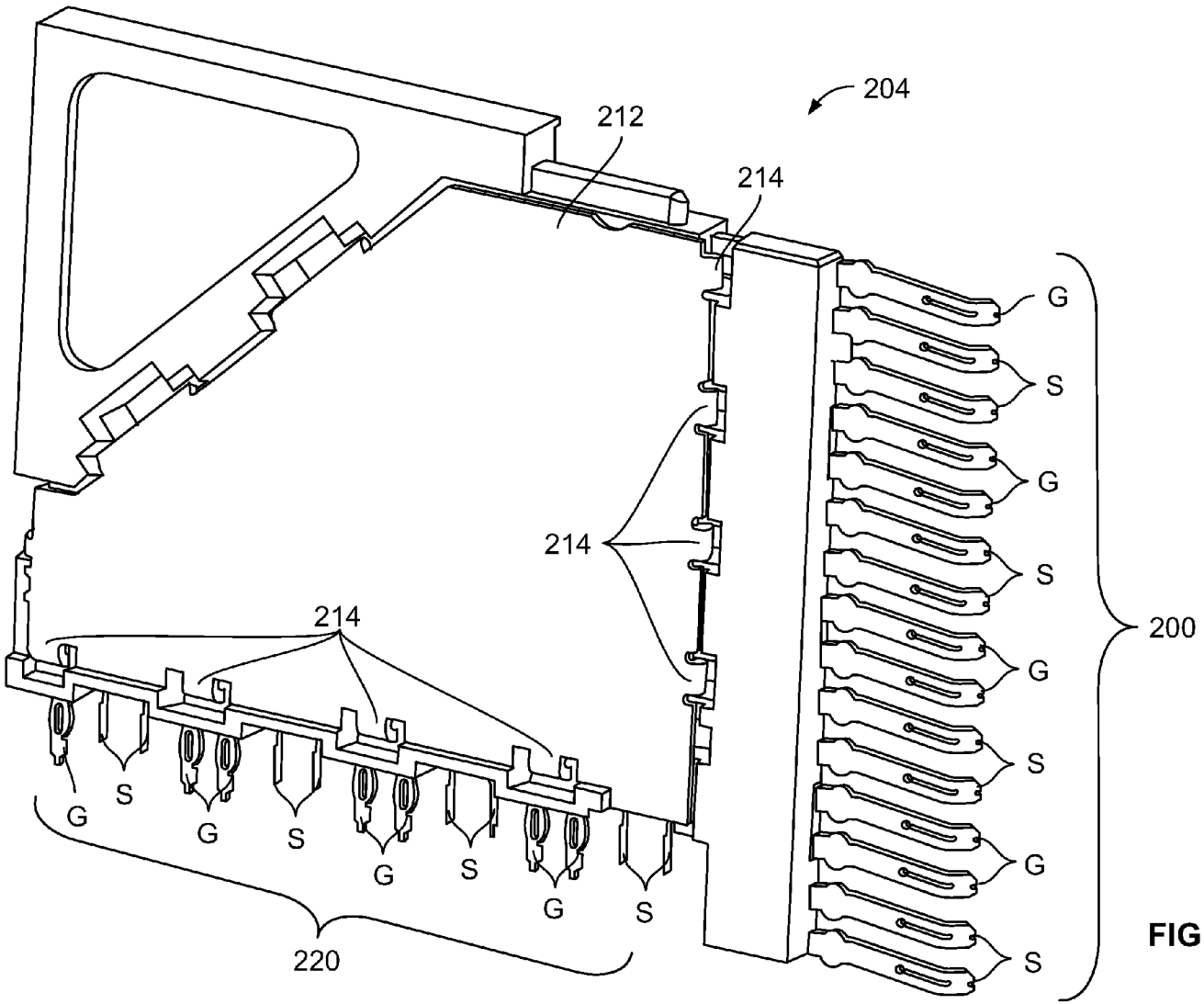
FIG. 3 is an assembled view of a contact module assembly shown in FIG. 2 with an example shield also shown in FIG. 2 affixed thereto.

FIG. 3 is an assembled view of the contact module assembly 204A (shown in FIG. 2), with an example shield 212 affixed thereto. While FIG. 3 illustrates the contact module assembly 204A, the contact module assembly 204B (shown in FIG. 2) also may include a similar shield 212. The mating contacts 200 of the contact module assembly 204A include a plurality of conductors, including both ground and signal conductors (identified in FIG. 3 with a G for ground conductors or an S for signal conductors). The ground and signal conductors G, S extend at least partially into the contact module assembly 204A. During assembly, the shield 212 is mounted to the contact module assembly 204A. The compliant pins 214 of the shield 212 are electrically and mechanically connected to the ground conductors G of the mating and mounting contacts 200, 220. In one or more embodiments, the shield 212 is electrically connected to less than all of the ground conductors G. When installed, the shield 212 defines a ground plane that is oriented parallel to, but in a non-coplanar relation with, the lead frame plane. In one embodiment, when the shield 212 is installed, the shield 212 at least partially covers each of the ground and signal conductors G, S of the lead frame 100. The shield 212 also is electrically connected with one or more of the ground conductors G. The ground conductors G are electrically connected to an electrical ground of the substrate (not shown) to which the connector assembly 100 (shown in FIG. 1) is mounted and/or an electrical ground of the mating connector (not shown) that mates with the connector assembly 100. As a result, the shield 212 may effectively shield the signal conductors S from an adjacent contact module assembly 204B (shown in FIG. 2) when the contact module assemblies 204A, 204B are assembled within the housing 102.

Figure 4:
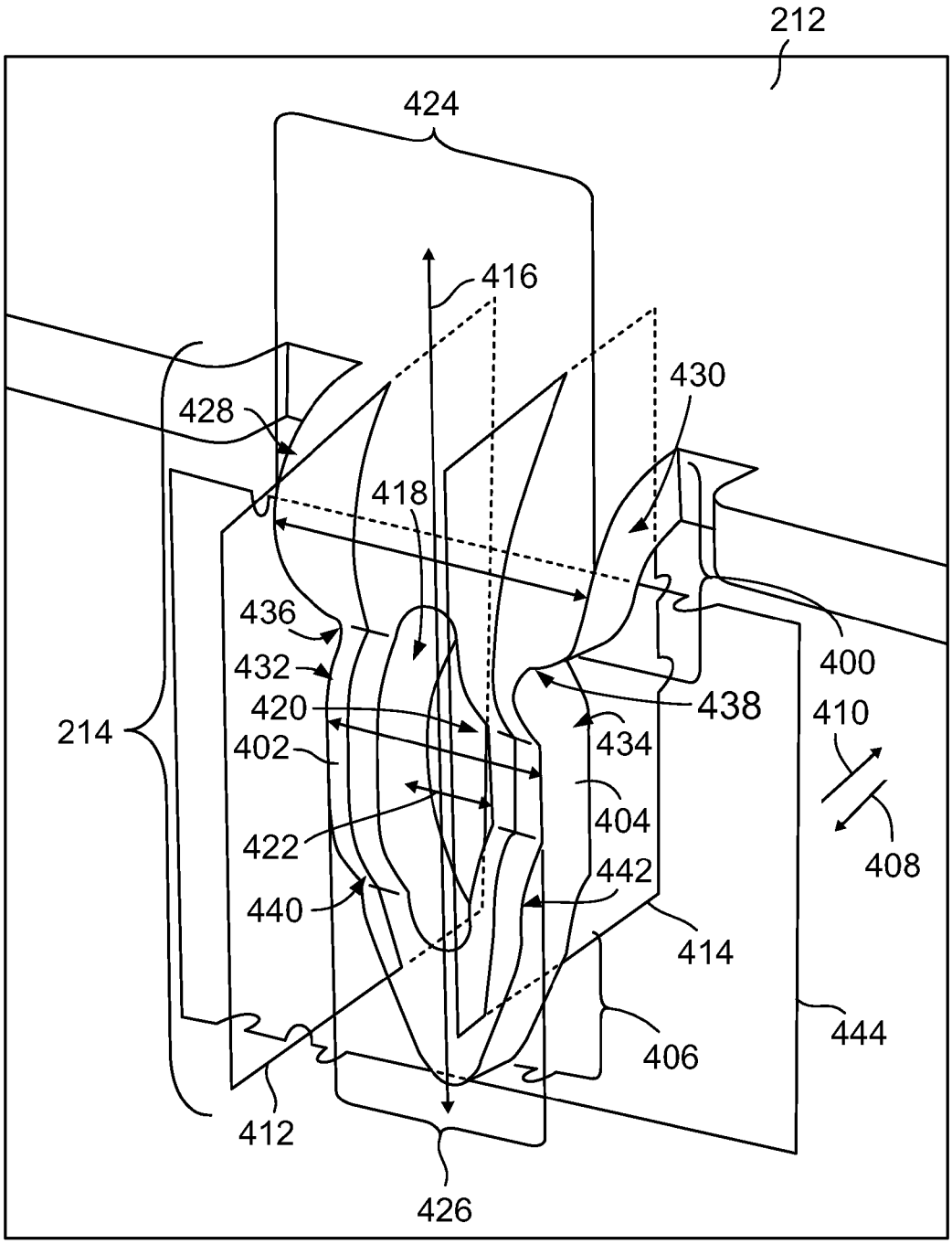
FIG. 4 is a perspective view of a compliant pin shown in FIG. 2 prior to the pin being press-fit into a lead frame shown in FIG. 2 according to one embodiment.

FIG. 4 is a perspective view of the compliant pin 214 prior to the pin 214 being press-fit into the lead frame 216 shown in FIG. 2 according to one embodiment. The compliant pin 214 and shield 212 include, or are formed from, a conductive material such as a metal material. For example, the compliant pin 214 and shield 212 may be homogeneously formed with one another from a common piece of conductive metal. In one embodiment, the pin 214 and the shield 212 are stamped and formed from a common sheet of metal. The pin 214 and shield 212 may be coated with a conductive material, such as a conductive plating.

The pin 214 is coupled with the shield 212 of the connector assembly 100 (shown in FIG. 1) by a neck 400. In the illustrated embodiment, the neck 400 is bent so that a longitudinal axis 416 of the pin 214 is approximately perpendicular to the shield 212. Alternatively, the neck 400 may be bent so that the longitudinal axis 416 is not perpendicular to the shield 212. For example, the longitudinal axis 416 may be parallel to the shield 212.

A plurality of beams 402, 404 is coupled to the neck 400 and interconnects the neck 400 with an insertion tip 406. The beams 402, 404 project from upper ends 436, 438 to lower ends 440, 442 along a longitudinal plane 444 of the pin 214. The upper ends 436, 438 are interconnected by the neck 400 and the lower ends 440, 442 are interconnected by the insertion tip 406. The longitudinal axis 416 of the pin 214 is disposed in the longitudinal plane 444. In the illustrated embodiment, the longitudinal plane 444 is transverse to the shield 212. For example, the longitudinal plane 444 is not parallel to the shield 212 in FIG. 4. In one embodiment, the longitudinal plane 444 is transverse to the shield 212 by being disposed at an acute angle with respect to the shield 212. In another embodiment, the longitudinal plane 444 is transverse to the shield 212 by being disposed approximately perpendicular to the shield 212. Alternatively, the pin 214 may be coupled to the shield 212 such that the longitudinal plane 444 is not transverse to the shield 212. For example, the longitudinal plane 444 may be parallel to the shield 212.

The beams 402, 404 are bent so that the beams 402, 404 outwardly protrude from the longitudinal plane 444 of the pin 214 in opposing directions. For example, the beams 402, 404 include arcuate shapes that are arched in different directions 408, 410 from the longitudinal plane 444 in the illustrated embodiment. The arcuate shape of the beams 402, 404 may include a shape that is an approximately smooth arch and a shape that includes one or more approximately flat edges or surfaces such as contact surfaces 606 (shown in FIG. 6) of the beams 402, 404. As shown in FIG. 4, the left beam 402 is arched in one direction 408 and the right beam 404 is arched in a different direction 410. In one embodiment, the directions 408, 410 oppose one another. For example, the directions 408, 410 may extend parallel to one another. Alternatively, the directions 408, 410 may be skew with respect to one another. For example, the directions 408, 410 may be disposed at an angle with respect to one another. The terms "left" and "right" are used merely as examples and are not intended to be limiting in any way. For example, the left beam 402 may be arched toward the direction 410 and the right beam 404 may be arched toward the other direction 408. The beams 402, 404 are disposed side-to-side so the beams 402, 404 are arched away from the longitudinal plane 444 in different beam planes 412, 414. The beam planes 412, 414 are parallel to one another and are transverse to the longitudinal plane 444 in the illustrated embodiment. For example, the beam planes 412, 414 may be disposed at one or more acute angles with respect to the longitudinal plane 444 or may be disposed approximately perpendicular to the longitudinal plane 444. In the illustrated embodiment, beams 402, 404 are separated from one another by a separation gap 422 that extends approximately perpendicular to the beam planes 412, 414 and along the longitudinal plane 444 such that the beams 402, 404 are not arched away from one another in a single plane.

The neck 400 has a neck width 424 along the longitudinal plane 444 that is greater than a beams width 426 of the beams 402, 404 that extends along the longitudinal plane 444 in the illustrated embodiment. For example, the neck width 424 between opposing neck sides 428, 430 of the neck 400 in the longitudinal plane 444 is larger than the beams width 426 between outer surfaces 432, 434 of the beams 402, 404 in the longitudinal plane 444. Providing the neck 400 with a greater neck width 424 than the beams width 426 of the beams 402, 404 can increase the strength of the pin 214 so as to reduce the possibility of the pin 214 buckling when the pin 214 is press-fit into a cavity 500 (shown in FIG. 5).

An inner surface 418 of the pin 214 defines an opening 420 between the beams 402, 404. For example, the inner surface 418 may define the approximately oval-shaped opening 420 in the longitudinal plane 444 shown in FIG. 4. The opening 420 may have a different shape in another embodiment and/or in a different plane. The opening 420 extends in the longitudinal plane 444 between the neck 400 and the insertion tip 406 and separates the beams 402, 404 from one another. The separation gap 422 defines the width of the opening 420 in the longitudinal plane 444.

The insertion tip 406 includes a pointed shape that is pointed along the longitudinal axis 416 of the pin 214. The pointed shape of the insertion tip 406 can reduce the force required to load the pin 214 into a cavity 500 (shown in FIG. 5) in the lead frame 216 (shown in FIG. 2). The insertion tip 406 projects away from the neck 400 along the longitudinal plane 444 in the illustrated embodiment.

Figure 5:
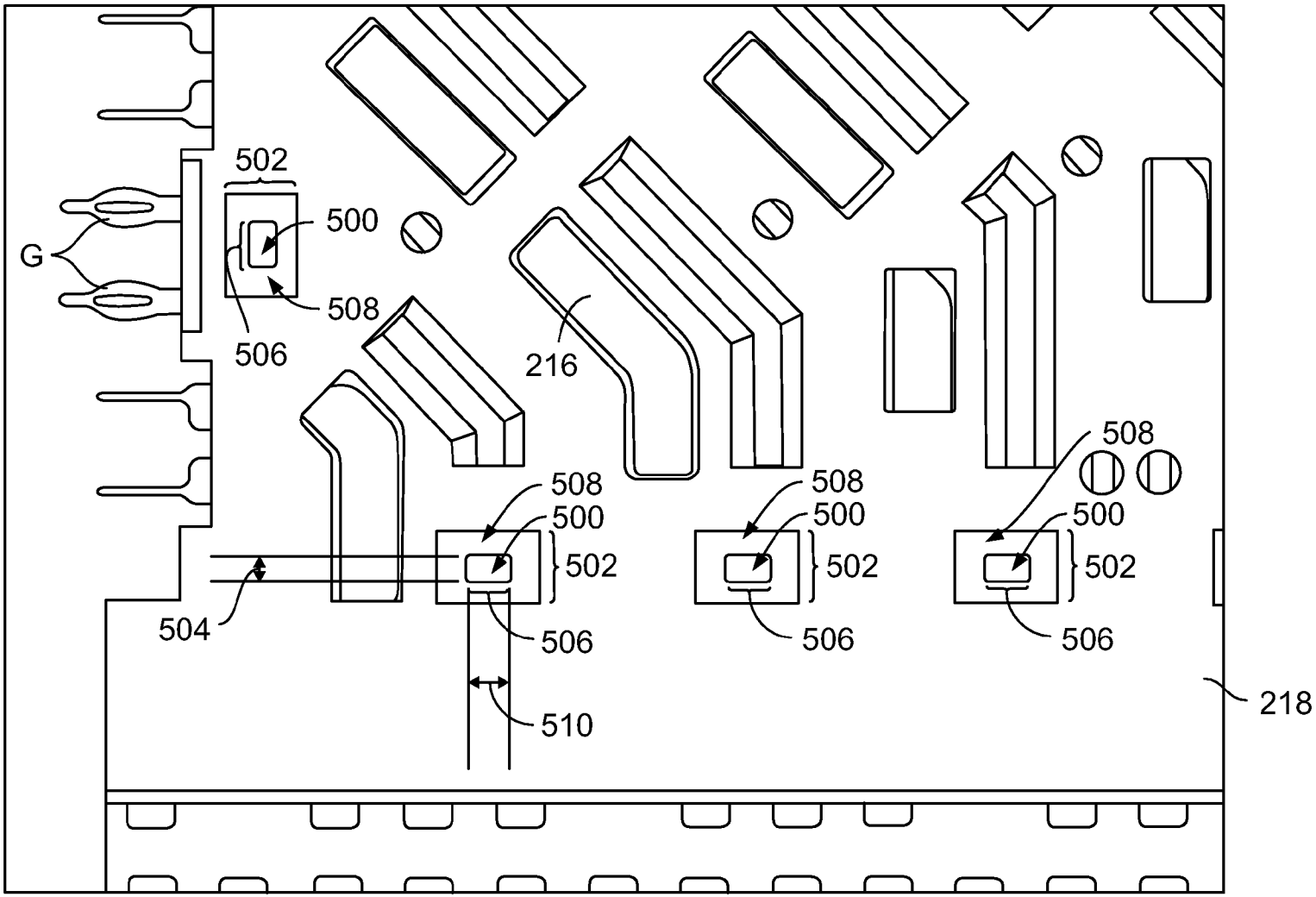
FIG. 5 illustrates a portion of the lead frame shown in FIG. 2 and a dielectric body also shown in FIG. 2.

FIG. 5 illustrates a portion of the lead frame 216 and the dielectric body 218 shown in FIG. 2 according to one embodiment. The lead frame 216 extends in a plane that is transverse to the pin 214 (shown in FIG. 2) in one embodiment. For example, a top surface 508 of the lead frame 216 may be disposed approximately perpendicular to, or at an acute angle with respect to, the longitudinal plane 444 (shown in FIG. 4) of the pin 214. The lead frame 216 includes a plurality of cavities 500 that are each shaped to receive the pins 214. The pins 214 are press-fit into the cavities 500 to mechanically secure and retain the shield 212 (shown in FIG. 2) with respect to the lead frame 216. The dielectric body 218 includes a plurality of access openings 502 located over the cavities 500. The access openings 502 are positioned to permit the pins 214 to be loaded into the cavities 500 so that the dielectric body 218 is located between the shield 212 and the lead frame 216 when the connector assembly 100 (shown in FIG. 1) is assembled. As described below, the pins 214 are press-fit into the cavities 500 to mechanically and electrically couple the shield 212 with the lead frame 216. The cavities 500 may be formed in the lead frame 216 such that an inner surface 616 (shown in FIG. 6) of the cavities 500 is electrically connected with the lead frame 216 and one or more ground conductors G. For example, the lead frame 216 may include, or be formed from a conductive material with the cavities 500 exposing an inner conductive portion of the lead frame 216. Alternatively, the inner surface 616 (shown in FIG. 6) of each cavity 500 may include, or be at least partially coated with, a conductive material. Mounting the shield 212 to the lead frame 216 using the pins 214 can electrically connect the shield 212 to an electric ground of the lead frame 216.

The cavities 500 define a polygon-shaped opening 506 in the top surface 508 of the lead frame 216 in one embodiment. For example, each of the cavities 500 in FIG. 5 defines a rectangular shaped opening 506 in the lead frame 216. Alternatively, the cavities 500 may define a different shaped opening 506 or a polygon-shaped opening 506 that is a polygon shape other than a rectangle. The openings 506 have a width 510 that is greater than a height 504 in the illustrated embodiment. For example, the width 510 of the openings 506 may be approximately 0.6 millimeters and the height 504 may be approximately 0.4 millimeters. In one embodiment, the width 510 and height 504 of the openings 506 are smaller than the dimensions of openings (not shown) in known lead frames (not shown) that receive pins (not shown) to electrically and mechanically connect a shield (not shown) with the lead frame. Reducing the size of the openings 506 can reduce the pitch of the pins 214 (shown in FIG. 2) that are press-fit into the cavities 500. For example, reducing the size of the openings 506 can allow for the cavities 500 and the pins 214 to be provided closer together than in known connector assemblies. Reducing the size of the openings 506 also can reduce the amount of conductive material that surrounds each opening 506. For example, reducing the dimensions of the openings 506 can reduce the amount of conductive material that is coated on the lead frame 216 around and/or in the cavities 500.

Figure 6:
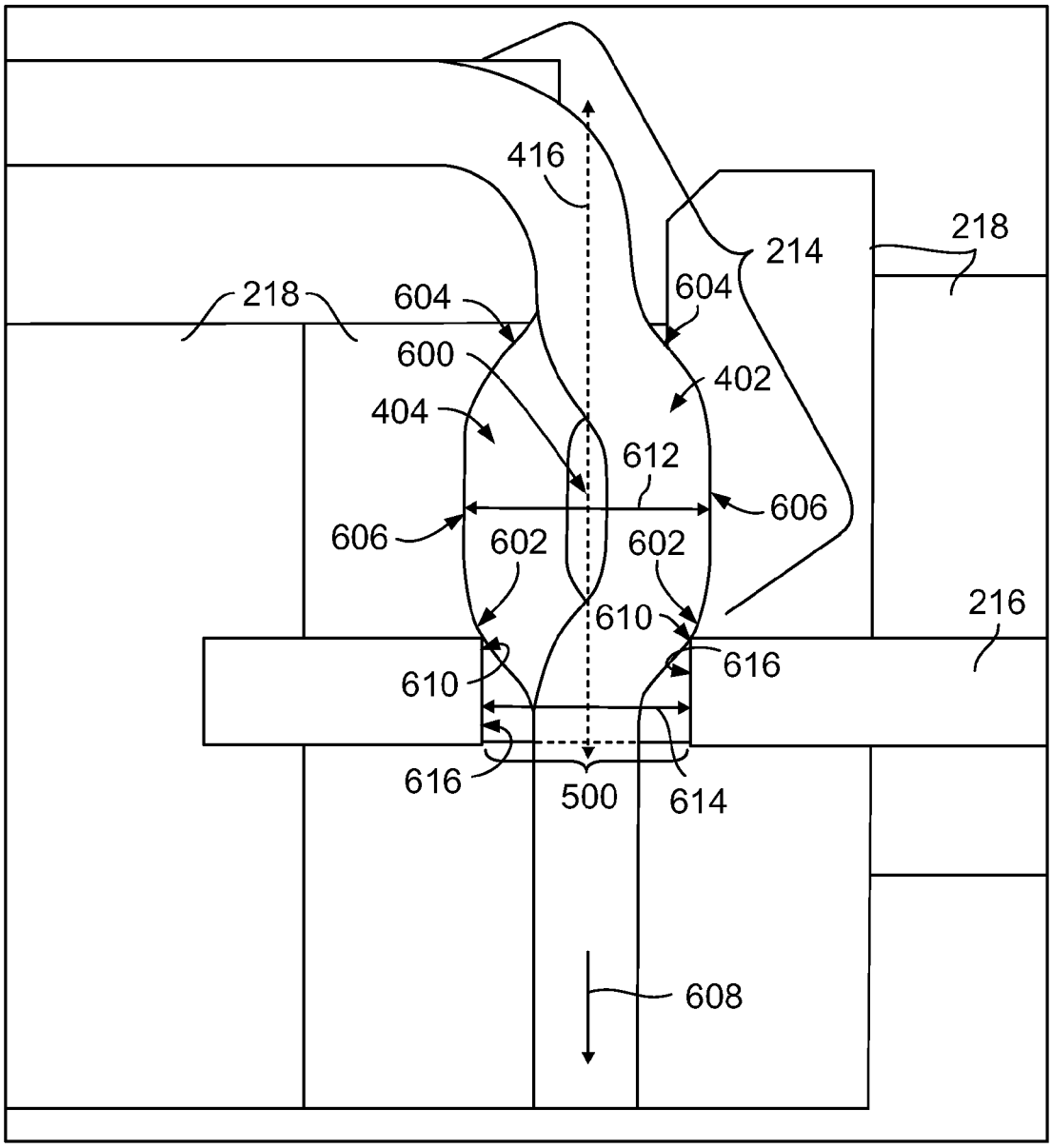
FIG. 6 is a side elevational view of the pin shown in FIG. 2 prior to loading the pin into a cavity shown in FIG. 5.

FIG. 6 is a side elevational view of the pin 214 prior to loading the pin 214 into the cavity 500 according to one embodiment. The lead frame 216 and dielectric body 218 are shown in cross-sectional view in FIG. 6. Additionally, the pin 214 in FIG. 6 is presented as though viewed from a direction that is transverse to the beam planes 412, 414 (shown in FIG. 4) and is along the longitudinal plane 444 (shown in FIG. 4). The longitudinal plane 444 may be represented by the longitudinal axis 416 as shown in FIG. 6. The pin 214 is loaded into the cavity 500 in a loading direction 608. The loading direction 608 is approximately parallel to the longitudinal axis 416 and along the longitudinal plane 444 of the pin 214 in one embodiment.

As described above, the beams 402, 404 are arched in opposing directions 408, 410 (shown in FIG. 4). In the illustrated embodiment, the beams 402, 404 are arched so as to define an opening 600 between the beams 402, 404 when the beams 402, 404 are viewed from a direction that is transverse to the longitudinal axis 416 and along the longitudinal plane 444 (shown in FIG. 4) of the pin 214. For example, the opening 600 is defined in a plane that is approximately parallel to the beam planes 412, 414 (shown in FIG. 4) and transverse to the longitudinal plane 444. Each of the beams 402, 404 includes lower and upper angled surfaces 602, 604 with a contact surface 606 between the lower and upper angled surfaces 602, 604. In the illustrated embodiment, the contact surfaces 606 are approximately parallel to one another. As the pin 214 is loaded into the cavity 500 in the loading direction 608, the lower angled surface 602 of each beam 402, 404 first engages an upper edge 610 of the cavity 500. The upper edge 610 of the cavity 500 is the edge of the opening 506 (shown in FIG. 5) defined by the cavity 500. A depth 612 of the beams 402, 404 is the distance between the contact surfaces 606 of the beams 402, 404 in a direction that is transverse to the longitudinal plane 444 (shown in FIG. 4). The depth 612 of the beams 402, 404 is greater than an inner dimension 614 of the cavity 500. The inner dimension 614 is the distance between opposing sides of an inner surface 616 of the cavity 500 in a direction that is parallel to the direction in which the depth 612 is measured.

Figure 7:
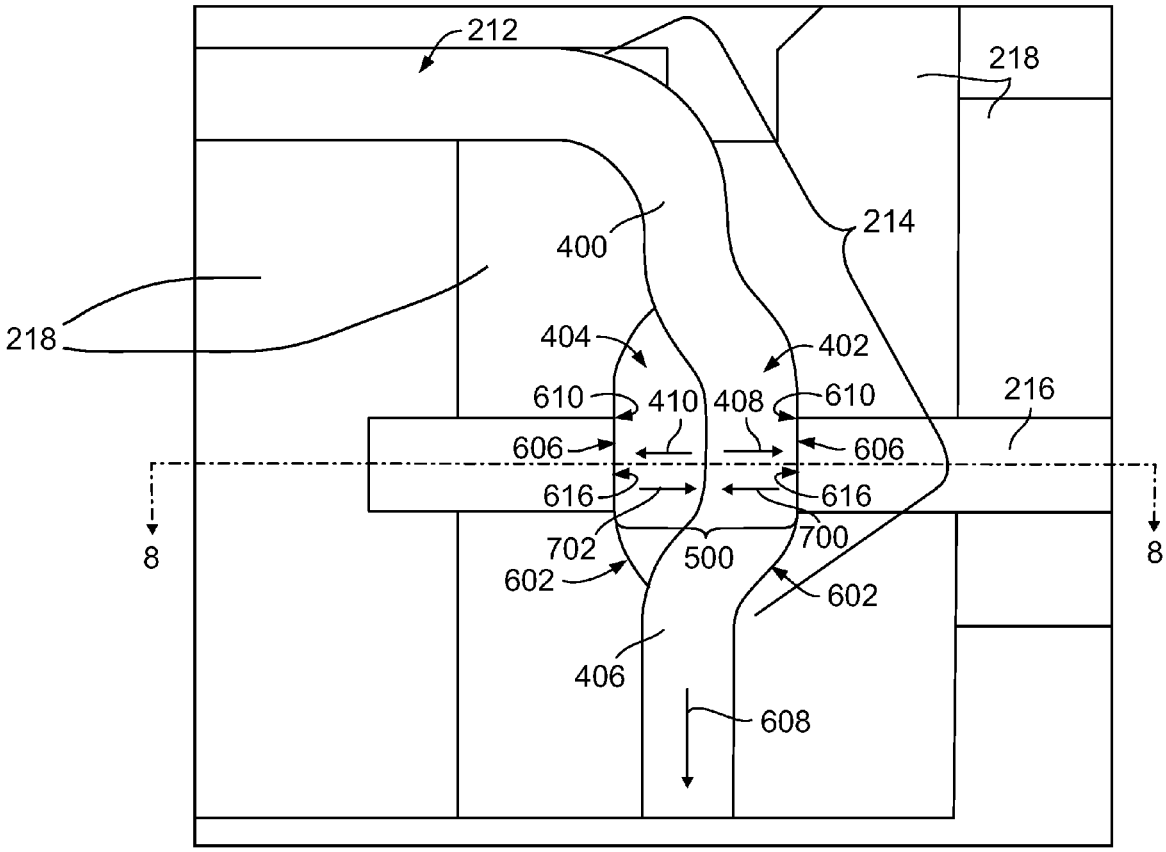
FIG. 7 is a side elevational view of the pin shown in FIG. 2 after being loaded into the cavity shown in FIG. 5.

FIG. 7 is a side elevational view of the pin 214 after being loaded into the cavity 500 according to one embodiment. In a manner similar to FIG. 6, FIG. 7 presents the lead frame 216 and dielectric body 218 in cross-sectional view and the pin 214 as though viewed from a direction that is transverse to the beam planes 412, 414 and is along the longitudinal plane 444 as shown in FIG. 4. The lower angled surfaces 602 of the beams 402, 404 slide along the upper edge 610 of the cavity 500 as the pin 214 is press-fit into the cavity 500 along the loading direction 608. The beams 402, 404 are deflected in deflection directions 700, 702 as the pin 214 is press-fit into the cavity 500. For example, as described above and shown in FIG. 4, the left beam 402 is arched along the direction 408 and the right beam 404 is arched along the different direction 410. Pressing the pin 214 into the cavity 500 causes the beams 402, 404 to be at least partially deflected toward the longitudinal plane 444 (shown in FIG. 4) in deflection directions 700, 702. For example, the beams 402, 404 may be partially flattened toward the longitudinal plane 444. In one embodiment, the deflection directions 700, 702 are different from one another. For example, the deflection directions 700, 702 may oppose one another. In another example, the deflection directions 700, 702 are disposed at an acute angle with respect to one another. In the illustrated embodiment, the deflection direction 700 of the beam 402 is substantially opposite to the direction 408 in which the beam 402 is arched in the beam plane 412 (shown in FIG. 4) and the deflection direction 702 of the beam 404 is substantially opposite to the direction 410 in which the beam 404 is arched in the beam plane 414 (shown in FIG. 4).

Once the pin 214 is press-fit into the cavity 500, the contact surfaces 606 of the beams 402, 404 engage one or more of the inner surface 616 and the upper edge 610 of the cavity 500 to retain the pin 214 in the cavity 500, and thus secure the shield 212 in position with respect to the lead frame 216. The contact surfaces 606 engage one or more of the inner surface 616 and the upper edge 610 to electrically connect the pin 214 and the lead frame 216.

With additional reference to FIG. 4, the beams 402, 404 are separated from one another by the separation gap 422 prior to, during and after the pin 214 is press-fit into the cavity 500 in one embodiment. The beams 402, 404 are separated from one another so that the beams 402, 404 do not substantially engage one another as the beams 402, 404 are deflected along the deflection directions 700, 702. For example, the portions of the inner surface 418 of the pin 214 that are located proximate to the beams 402, 404 are separated from one another such that the beams 402, 404 do not rub against, slide against or otherwise engage one another when the pin 214 is press-fit into the cavity 500 such that the beams 402, 404 do not frictionally engage one another. In one embodiment, the greatest separation gap 422 in the longitudinal plane 444 between the beams 402, 404 is approximately the same before and after the pin 214 is press-fit into the cavity 500. For example, the initial width of the opening 420 may not substantially change after the pin 214 is press-fit into the cavity 500. In another example, the opening 420 separates the beams 402, 404 and extends between the neck 400 and the insertion tip 406 before and after the pin 214 is press-fit into the cavity 500 and the beams 402, 404 are biased in the directions 700, 702.

The beams 402, 404 do not substantially engage one another to avoid significantly increasing the amount of loading force that is applied to the pin 214 in the loading direction 608 to press-fit the pin 214 into the cavity 500. For example, the beams 402, 404 do not substantially engage one another when the pin 214 is press-fit into the cavity 500 to avoid requiring a loading force that would cause the pin 214 to buckle if the pin 214 is misaligned with respect to the cavity 500. In another example, the loading force that is applied to the pin 214 in the loading direction 608 to press-fit the pin 214 in the cavity 500 is reduced over known compliant pins. Reducing the amount of loading force that is required to press-fit the pin 214 into the cavity 500 can reduce the chances of the pin 214 buckling. For example, as the amount of insertion force that is required to press-fit a known pin (not shown) into a known cavity (not shown) increases, the pin is more likely to buckle. Conversely, as the amount of insertion force that is required to press-fit the pin 214 is reduced over known pins, the pin 214 is less likely to buckle when loaded into the cavity 500.

Keeping the beams 402, 404 separated as the pin 214 is press-fit into the cavity 500 can prevent parts of the beams 402, 404 from shearing or peeling off of the pin 214. For example, a conductive plating on the pin 214 may be prevented from being skived from the beams 402, 404 by separating the beams 402, 404 from one another during loading of the pin 214 into the cavity 500. In doing so, at least some of the conductive plating on the beams 402, 404 is protected from being removed, thus exposing the underlying base material of the pin 214, in one embodiment.

In the illustrated embodiment, the beams 402, 404 are deflected toward the deflection directions 700, 702 as the pin 214 is loaded into the cavity 500 sufficiently far so that the opening 600 (shown in FIG. 6) is closed in a plane that is approximately parallel to the beam planes 412, 414 and transverse to the longitudinal plane 444. For example, the opening 600 that is visible from a direction that is transverse to the beam planes 412, 414 (shown in FIG. 4) prior to press-fitting the pin 214 into the cavity 500 may no longer be visible from this same direction after the pin 214 is loaded into the cavity 500. The opening 600 may no longer be visible due to the biasing of the beams 402, 404 toward directions 700, 702 sufficiently far to eliminate or close the opening 600 when viewed from the direction transverse to the beam planes 412, 414.

Figure 8:
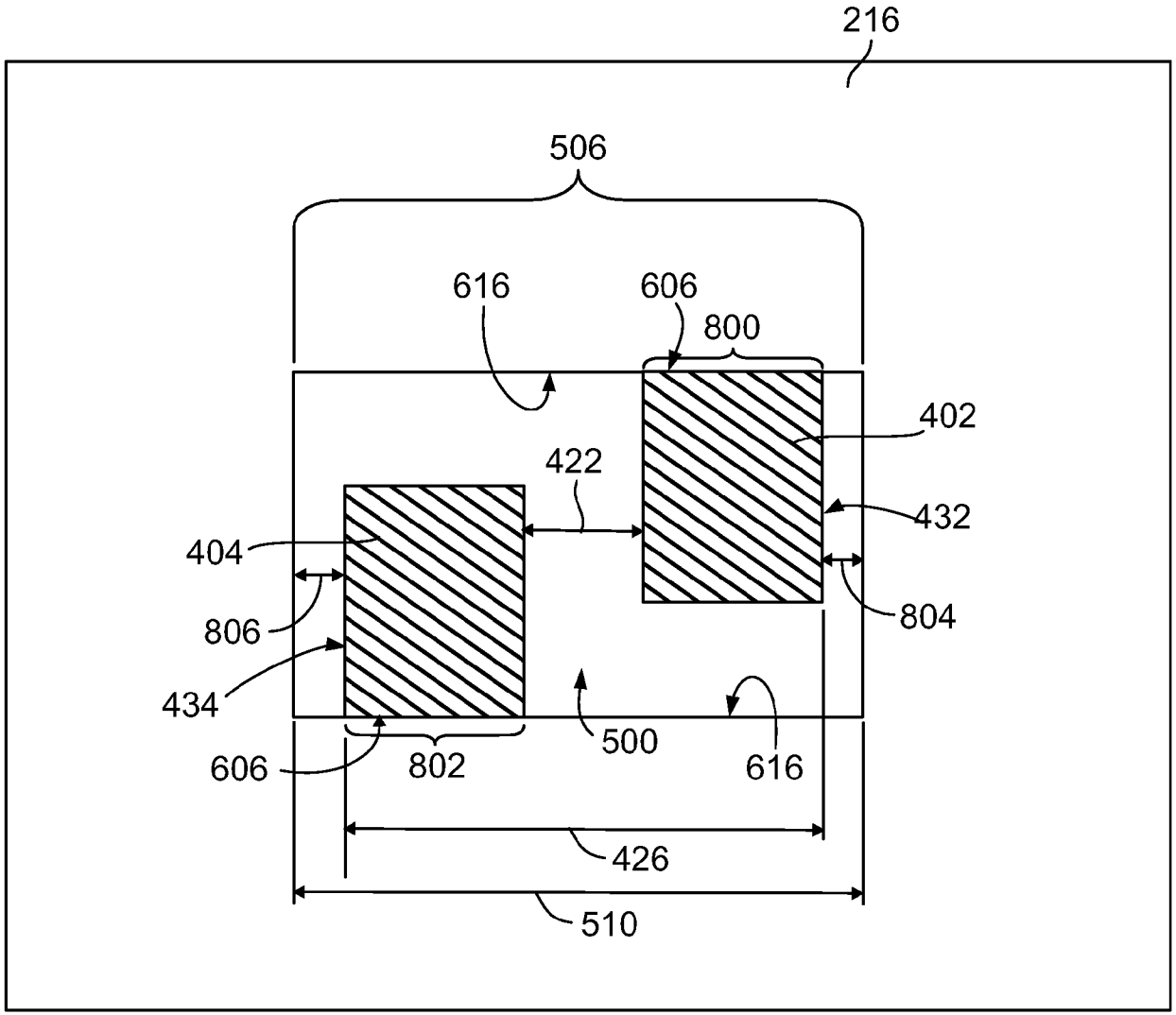
FIG. 8 is a partial cross sectional view of a plurality of beams shown in FIG. 4 after the pin shown in FIG. 2 is press-fit into the cavity shown in FIG. 5 taken along line 8-8 in FIG. 7.

FIG. 8 is a partial cross-sectional view of the beams 402, 404 after the pin 214 (shown in FIG. 2) is press-fit into the cavity 500 taken along line 8-8 in FIG. 7. Only cross-sections of the beams 402, 404 are shown in FIG. 8 with the rest of the pin 214 removed from the view of FIG. 8. As described above, the beams 402, 404 are separated by the separation gap 422 prior to and after the pin 214 is press-fit into the cavity 500 in one embodiment. The beams 402, 404 have a polygon-shaped cross-sectional shape in a plane that is parallel to the top surface 508 (shown in FIG. 5) of the lead frame 216. For example, the beams 402, 404 may have a square- or rectangular-shaped cross-section. The cross-sectional shape of the beams 402, 404 can increase the retention of the pin 214 in the cavity 500. For example, the cross-sectional shape of the beams 402, 404 can increase the surface area of the interface between the beams 402, 404 and the lead frame 216. Increasing the surface area of the interface between the beams 402, 404 and the lead frame 216 can increase the amount of force required to remove the pin 214 from the cavity 500.

For example, the interface between the pin 214 (shown in FIG. 2) and the lead frame 216 includes a plurality of interface areas 800, 802 between the contact surfaces 606 of the beams 402, 404 and at least one of the inner surface 616 and the upper edge 610 of the cavity 500. While only the inner surface 616 is labeled in FIG. 8, the upper edge 610 also may be labeled using the same arrow as is used to label the location of the inner surface 616. The interface areas 800, 802 include the surface area in which the contact surfaces 606 engage the inner surface 616 within the cavity 500 and/or the upper edge 610 of the cavity 500. The engagement between the substantially flat contact surfaces 606 and one or more of the inner surface 616 and upper edge 610 increases the surface area of the interface areas 800, 802 between the pin 214 and the lead frame 216 when compared to known pins (not shown) and cavities (not shown) of a similar size and of a different shape. Increasing this surface area causes the force required to remove the pin 214 from the cavity 500 to be increased.

In one embodiment, the width 510 of the opening 506 defined by the cavity 500 is greater than the beam width 426 of the beams 402, 404. For example, the opening 506 of the cavity 500 may be sufficiently large such that one or more side gaps 804, 806 are provided between outside surfaces 432, 434 of the beams 402, 404 and opposing sides of the inner surface 616 of the cavity 500. The outside surfaces 432, 434 of the beams 402. 404 include the outermost surfaces of the beams 402, 404 in a plane that is perpendicular to the beam planes 412, 414 in one embodiment. For example, the beans width 426 of the beams 402, 404 may be defined as the distance between the outside surfaces 432, 434 of the beams 402, 404 in a direction that is perpendicular to the one or more of the beam planes 412, 414 and the longitudinal axis 416 (shown in FIG. 4) of the pin 214. The opening 506 may be sufficiently large to provide the side gaps 804, 806 when the pin 214 is press-fit into the cavity 500 to provide additional tolerance for the loading of the pin 214 into the cavity 500. For example, inclusion of the side gaps 804, 806 can provide additional tolerance for the location of the pin 214 in the cavity 500 so that the pin 214 does not need to be perfectly centered in the opening 506.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a contact module assembly comprising a lead frame having a cavity and configured to electrically connect the connector assembly with an electric ground; and a shield having a compliant pin press-fit into the cavity to retain the shield with respect to the lead frame and to electrically connect the shield with the electric ground, the pin comprising:

a neck interconnecting the pin with the shield;

a plurality of compliant beams configured to engage an inner surface of the cavity to retain the pin in the cavity, the beams arranged side-to-side and projecting along a longitudinal plane in a loading direction, the beams having arcuate portions arched in different directions transverse to the longitudinal plane, the arcuate portions being shaped to deflect toward the longitudinal plane without substantially engaging one another; and an insertion tip interconnecting ends of the beams.

2. The connector assembly of claim 1, wherein the beams of the pin are deflected along non-intersecting deflection paths when the pin is press-fit into the cavity.

3. The connector assembly of claim 1, wherein the beams comprise substantially flat contact surfaces that engage the inner surface of the cavity to electrically connect the pin and the inner surface of the cavity, the contact surfaces being substantially parallel to one another.

4. The connector assembly of claim 1, wherein the beams are separated from one another to avoid frictionally engaging one another when the pin is press-fit into the cavity.

5. The connector assembly of claim 1, wherein a separation distance between the beams along the longitudinal plane is approximately constant prior to and after the pin is press-fit into the cavity.

6. The connector assembly of claim 1, wherein the neck of the pin has an exterior width along the longitudinal plane that is greater than an exterior width of the plurality of beams along the longitudinal plane.

7. The connector assembly of claim 1, wherein the pin defines an opening between the beams in a plane transverse to the longitudinal plane prior to the pin being press-fit into the cavity.

8. The connector assembly of claim 7, wherein the beams are deflected toward the longitudinal plane to close the opening in the transverse plane when the pin is press-fit into the cavity.

9. The connector assembly of claim 1, wherein the cavity defines a polygon-shaped opening in a plane that is transverse to the longitudinal plane of the pin, the beams comprising substantially flat surfaces that engage opposing sides of the polygon-shaped opening.

10. The connector assembly of claim 1, wherein the cavity extends along a cavity width that is wider in a plane transverse to the longitudinal plane of the pin than an exterior width of the beams after the pin is press-fit into the cavity.

11. A connector assembly comprising:

a housing;

contact module assemblies disposed in the housing, the contact module assemblies including conductive lead frames located in dielectric bodies and including cavities disposed on at least one side of the dielectric bodies, the lead frames including mounting contacts configured to be mounted to a circuit board; and a conductive shield coupled with at least one of the contact module assemblies, the shield including compliant pins received in the cavities of the at least one of the lead frames to electrically couple the shield with the lead frames and the mounting contacts, the compliant pins including compliant beams that engage inner surfaces of the cavities, the beams arranged side-to-side and projecting along a longitudinal plane in a loading direction, the beams having arcuate portions arched in different directions that are transverse to the longitudinal plane, the arcuate portions being shaped to deflect toward the longitudinal plane without substantially engaging one another when the pins are loaded into the cavities.

12. The connector assembly of claim 11, wherein the pins of the conductive shield include insertion tips that interconnect ends of the beams of the pins.

13. The connector assembly of claim 11, wherein the arcuate portions of the pins are arched in opposing directions.

14. The connector assembly of claim 11, wherein the beams of the pins are deflected along non-intersecting deflection paths when the pins are press-fit into the cavities.

15. The connector assembly of claim 11, wherein the beams of the pins comprise substantially flat contact surfaces that engage the inner surfaces of the cavities to electrically connect the pins and the inner surfaces of the cavities, the contact surfaces of each pin being substantially parallel to one another.

16. The connector assembly of claim 11, wherein the beams of the pins are separated from one another to avoid frictionally engaging one another when the pins are loaded into the cavities.

17. The connector assembly of claim 11, wherein a separation distance between the beams of each of the pins along the longitudinal plane is approximately constant prior to and after the pins are press-fit into the cavities.

18. The connector assembly of claim 11, wherein the pins of the shield include necks that interconnect the beams with the shield, the necks having exterior widths along the longitudinal plane that are greater than exterior widths of the beams along the longitudinal plane.

19. The connector assembly of claim 11, wherein the cavities of the contact module assemblies define polygon-shaped openings in a plane that is transverse to the longitudinal plane, the beams comprising substantially flat surfaces that engage opposing sides of the polygon-shaped openings.

20. The connector assembly of claim 11, wherein the pins of the shield define openings between the beams in planes that are transverse to the longitudinal plane prior to the pins being press-fit into the cavities, the beams being deflected toward the longitudinal plane to close the openings in the transverse plane when the pins are press-fit into the cavities.

* * * * *